US008406667B2

(12) United States Patent
Yagawara et al.

(10) Patent No.: US 8,406,667 B2
(45) Date of Patent: Mar. 26, 2013

(54) FIXING DEVICE, IMAGE FORMING APPARATUS, AND FIXING METHOD USING AN OILING UNIT AND REMOVING MEMBER

(75) Inventors: Makoto Yagawara, Ibaraki (JP); Tsukasa Onose, Ibaraki (JP); Souichi Nakazawa, Ibaraki (JP); Sho Sawahata, Ibaraki (JP); Ken Onodera, Ibaraki (JP); Masahiro Mizuno, Ibaraki (JP); Soushi Kikuchi, Ibaraki (JP); Takahiro Inoue, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 311 days.

(21) Appl. No.: 12/891,038

(22) Filed: Sep. 27, 2010

(65) Prior Publication Data

US 2011/0076069 A1 Mar. 31, 2011

(30) Foreign Application Priority Data

Sep. 28, 2009 (JP) ..... 2009-222899

(51) Int. Cl.
*G03G 15/20* (2006.01)

(52) U.S. Cl. ..... 399/325

(58) Field of Classification Search ..... 399/324, 399/325, 326, 327; 219/216; 118/60, DIG. 1
See application file for complete search history.

(56) References Cited

U.S. PATENT DOCUMENTS 3,883,291 A * 5/1975 Cloutier et al. ..... 432/60
3,913,521 A * 10/1975 Bar-on ..... 118/60
4,011,831 A * 3/1977 Braun et al. ..... 399/324
5,625,859 A * 4/1997 Moser ..... 399/325
6,266,509 B1 * 7/2001 Ota et al. ..... 399/325
7,708,377 B2 * 5/2010 Thayer et al. ..... 347/33

FOREIGN PATENT DOCUMENTS

| | | | |
|---|---|---|---|
| JP | 63-101882 | | 5/1988 |
| JP | 06019351 | A * | 1/1994 |
| JP | 8-14740 | | 2/1996 |
| JP | 08095416 | A * | 4/1996 |
| JP | 11272109 | A * | 10/1999 |
| JP | 2000-214716 | | 8/2000 |
| JP | 2000-321914 | | 11/2000 |
| JP | 2007-65100 | | 3/2007 |
| JP | 2008-158201 | | 7/2008 |
| JP | 2008-209585 | | 9/2008 |
| JP | 2009-36809 | | 2/2009 |
| JP | 2009-42496 | | 2/2009 |
| JP | 2009-63884 | | 3/2009 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A fixing device includes: a fixing member that fixes a toner image onto a recording medium; a pressing member that presses the recording medium against the fixing member; an oiling unit that applies release oil onto a surface of the fixing member to clean the surface; a removing member that is arranged between an downstream side of the oiling unit and an upstream side of the pressing member in a rotating direction of the fixing member and movable between an in-contact state where the removing member is in contact with the surface of the fixing member and an out-of-contact state where the removing member is out of contact with the surface; a drive unit that drives the removing member; and an oiling control unit that, when starting earliest fixing, controls the drive unit to gradually move the removing member from the in-contact state into the out-of-contact state.

18 Claims, 9 Drawing Sheets

(S301)
BEFORE START OF WEB CONVEYANCE (S302)
IMMEDIATELY AFTER START OF WEB CONVEYANCE (S401)
BEFORE START OF WEB CONVEYANCE (S402)
DURING PRINTING

FIXING DEVICE, IMAGE FORMING APPARATUS, AND FIXING METHOD USING AN OILING UNIT AND REMOVING MEMBER

CROSS-REFERENCE TO RELATED APPLICATIONS

The present application claims priority to and incorporates by reference the entire contents of Japanese Patent Application No. 2009-222899 filed in Japan on Sep. 28, 2009.

BACKGROUND OF THE INVENTION

1. Field of the Invention

The present invention relates to a fixing device that fixes an image, which has been electrostatically transferred onto a print medium, onto the print medium by heat and pressure, an image forming apparatus, and a fixing method.

2. Description of the Related Art

Electrophotography has been extensively used in printers, particularly in printers for high-volume output at high speed. Some type of the electrophotographic printers include a fixing unit that applies oil onto a heating roller and wipes off remaining toner on the heating roller to prevent transfer of residual toner. Such an electrophotographic printer is typically configured such that a fixed amount of oil is constantly supplied to an oiling web, such as felt, from an oil tank by using a pump or the like to apply the oil onto the heating roller.

Examples of such an image forming apparatus that utilizes a fixing unit include electrophotographic image forming apparatuses that form images at high speed on a web (imaging web), which is an elongated recording medium or a medium carrier sheet. One example of such an electrophotographic image forming apparatus is disclosed in Japanese Patent Application Laid-open No. 2008-158201.

Japanese Patent Application Laid-open No. 2008-209585 discloses a fixing unit that controls amount of oil to be supplied to an oiling web from an oil tank by changing rotation speed of an oiling roller, thereby preventing excessive oil on the oiling web.

Japanese Patent Application Laid-open No. S63-101882 discloses a fixing unit that includes: an endless oiling web that applies oil onto a heating roller of the fixing unit to clean the heating roller; and a cleaning mechanism that is compact but capable of accommodating a great length of the oiling web by folding the oiling web in accordion fold. This technique allows a fixed amount of oil to be supplied to the heating roller 11 constantly. Unfortunately, this technique is disadvantageous in that, because the oiling web is in constant contact with the heating roller and continuously supplying oil to the heating roller, amount of oil supplied to the surface of the heating roller is uncontrollable.

Japanese Patent Application Laid-open No. 2000-321914 discloses a fixing unit, in which an elastic member presses an oiling web against a fixing roller via a pressing roller at a constant pressure, and an elastic member presses a cleaning blade formed from heat-resistant resin or metal against the fixing roller at a constant pressure in an upstream side of the position of pressing the oiling web, in order to prevent dust from sticking to the fixing roller.

Japanese Patent Application Laid-open No. 2000-214716 discloses a technique for adjusting various parameters that include amount of oil to be applied, a feed speed of a cleaning web, pressure of the cleaning web, pressure of a separation claw, fixing temperature, and a conveying speed of recording paper in order to reduce jam of the recording paper in a fixing device.

Description will be made with reference to FIG. 9A and FIG. 9B. Generally, oil 18 applied to a heating roller 11 of a fixing unit is continuously consumed on the heating roller 11 by an imaging web 6 during the imaging web 6 is conveyed. Before conveyance of the web, the oil 18 is not consumed by the imaging web 6 because the imaging web 6 is out of contact with the heating roller 11 as illustrated in FIG. 9A (S301). Accordingly, before conveyance of the web, a large amount of oil 18 is applied onto a surface of the heating roller 11 using an oiling web 10 compared to during the conveyance of the imaging web 6. If printing is performed using an imaging web to which sticker paper 6*p* is glued, then immediately after conveyance of the imaging web is started, a large amount of oil 18 on the heating roller 11 is transferred onto a surface of the sticker paper 6*p* as illustrated in FIG. 9B (S302), thereby causing a reduction of pressure of the sticker paper 6*p* against the imaging web 6.

If a small amount of oil 18 is supplied to the oiling web 10, appropriate oil supply can be attained before the conveyance of the imaging web as illustrated in FIG. 10A (S401). During the printing, however, a tiny amount of oil 18 is applied to the sticker paper 6*p* as illustrated in FIG. 10B (S402), which causes poor releasability between a toner image 5 and the heating roller 11. As a result, the toner image 5 undesirably adheres to the surface of the heating roller 11. Once the oil 18 is supplied to the oiling web 10, it is substantially difficult to greatly reduce the amount of the oil 18 only while the conveyance of the imaging web is stopped. Therefore, it is difficult to reduce the oil supply to the surface of the heating roller 11 only while the web conveyance is stopped.

SUMMARY OF THE INVENTION

It is an object of the present invention to at least partially solve the problems in the conventional technology.

According to one aspect of the present invention, there is provided a fixing device including: a fixing member that fixes a toner image onto a recording medium, the fixing member being rotatably arranged so as to be opposed to a surface, on which the toner image has been formed, of the recording medium; a pressing member that presses the recording medium against the fixing member from a back surface side of the recording medium; an oiling unit that applies release oil onto a surface of the fixing member to clean the surface of the fixing member; an oil supplying unit that supplies the release oil to the oiling unit; a removing member that is arranged between a downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member; a drive unit that drives the removing member; and an oiling control unit that, when starting earliest fixing onto the recording medium, controls the drive unit such that the removing member gradually moves from the in-contact state to the out-of-contact state.

According to another aspect of the present invention, there is provided an image forming apparatus including: a photosensitive member; an electrostatic charging unit that uniformly electrostatically charges the photosensitive member; an exposure device that exposes a surface of the photosensitive member which has been electrostatically charged, with image light to form a latent image; a developing device that develops the latent image into a toner image; a transfer unit that transfers the toner image onto a recording medium by using an image carrier; and a fixing device that fixes the toner image onto the recording medium, wherein the fixing device includes: a fixing member that fixes the toner image onto the recording medium, the fixing member being rotatably arranged so as to be opposed to a surface, on which the toner image has been formed, of the recording medium; a pressing member that presses the recording medium against the fixing member from a back surface side of the recording medium; an oiling unit that applies release oil onto a surface of the fixing member to clean the surface of the fixing member; an oil supplying unit that supplies the release oil to the oiling unit; a removing member that is arranged between a downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member; a drive unit that drives the removing member; and an oiling control unit that, when starting earliest fixing onto the recording medium, controls the drive unit such that the removing member gradually moves from the in-contact state to the out-of-contact state.

According to still another aspect of the present invention, there is provided a fixing method for use in a fixing device, the fixing device including: a fixing member that fixes a toner image onto a recording medium, the fixing member being rotatably arranged so as to be opposed to a surface, on which the toner image has been formed, of the recording medium; a pressing member that presses the recording medium against the fixing member from a back surface side of the recording medium; an oiling unit that applies release oil onto a surface of the fixing member to clean the surface of the fixing member; an oil supplying unit that supplies the release oil to the oiling unit; and a removing member that is arranged between an downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member, the fixing method including, when starting earliest fixing onto the recording medium, moving the removing member gradually from the in-contact state to the out-of-contact state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
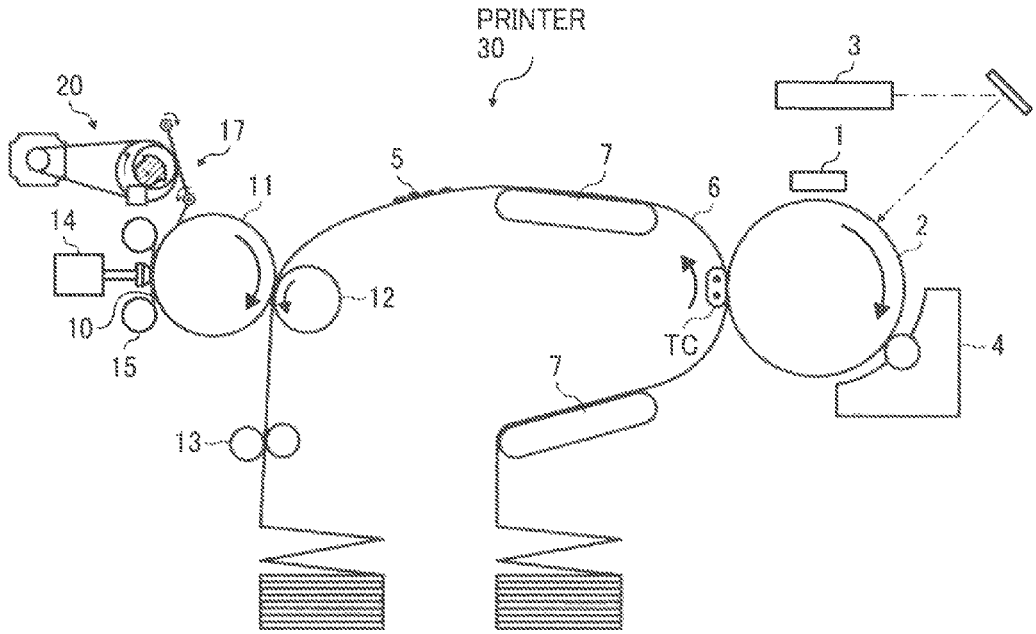
FIG. 1 is a block diagram schematically illustrating an image forming mechanism of a printer according to preferred embodiments of the present invention.

Preferred embodiments of the present invention will be explained with reference to accompanying drawings. FIG. 1 is a block diagram schematically illustrating an image forming mechanism of a printer 30 which is an image forming apparatus according to an embodiment of the present invention. The image forming mechanism according to the embodiment includes an electrostatic charger 1 serving as an electrostatic charging unit, a photosensitive member 2, a laser exposure device 3, a developing device 4, an elongated web (imaging web) 6, web conveying units 7, a heating roller 11 serving as a fixing member, a backing-up roller 12 serving as a pressing member, an oiling web 10 serving as an oiling unit, an oil supplying unit 14, a drive mechanism unit 15, puller rollers 13, and an electromotive drive unit 20.

A plurality of pieces of sticker paper 6*p* serving as printing paper, each on which an image is to be formed, are glued to a surface of the imaging web 6. The heating roller 11 is rotatably arranged so as to be opposed to the surface of the imaging web 6. The heating roller 11 fixes an toner image 5 formed on each of the pieces of pressure sticker paper 6*p* on the imaging web 6, onto each of the pieces of sticker paper 6*p*. The backing-up roller 12 presses the imaging web 6 against the heating roller 11 from a back surface side of the imaging web 6 when fixing is performed. The oiling web 10 is used for applying oil (release oil) onto the heating roller 11 to clean the heating roller 11. The oil supplying unit 14 supplies the oil to the oiling web 10 using a pump. The drive mechanism unit 15 sequentially provides the heating roller 11 with a new portion of the oiling web 10. The puller rollers 13 output the imaging web 6. The electromotive drive unit 20, which constitutes a drive unit, drives an end portion 17*d* of a release-oil removing blade 17 to move towards and away from the heating roller 11.

Figure 2:
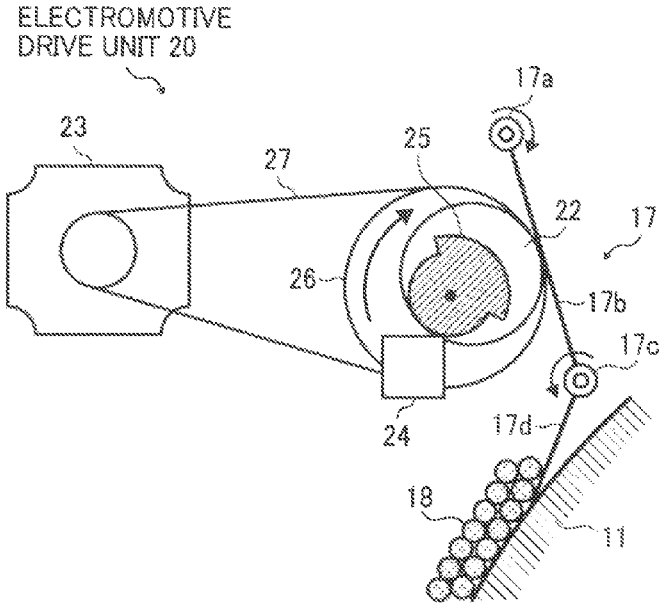
FIG. 2 is an enlarged side view schematically illustrating an electromotive drive unit according to the embodiments of the present invention.

In the present embodiment, the drive unit includes the electromotive drive unit 20, a first torsion spring 17*a* (see FIG. 2), and a second torsion spring 17*c* (see FIG. 2).

A fixing heater is provided inside the heating roller 11. When the fixing heater is energized, temperature (fixing temperature) of the heating roller 11 increases.

The laser exposure device 3 performs exposure to form a latent image on a surface of the photosensitive member 2 that has been electrostatically charged by the electrostatic charger 1. The latent image is developed by the developing device 4, and thus the toner image 5 is formed on the surface of the photosensitive member 2. The imaging web 6 is conveyed by the web conveying units 7. A transfer device TC serving as a transfer unit transfers the toner image 5 on the photosensitive member 2 onto the sticker paper 6*p* on the imaging web 6. After that, the imaging web 6 is further conveyed to pass between the heating roller 11 and the backing-up roller 12. While the imaging web 6 passes between the heating roller 11 and the backing-up roller 12, the toner image 5 is fixed, or fused, onto the sticker paper 6*p*. Then the imaging web 6 is output by the puller rollers 13.

FIG. 2 illustrates a schematic configuration of the drive unit that drives the release-oil removing blade. The drive unit according to the present embodiment includes the electromotive drive unit 20, the first torsion spring 17*a*, and the second torsion spring 17*c*. The electromotive drive unit 20 includes a stepping motor 23, a timing belt 27, a pulley 26, an eccentric cam 22, a reflector 25, and a sensor 24.

The stepping motor 23 is an electric motor capable of changing rotation speed in a stepwise fashion. The timing belt 27 transmits driving force of the stepping motor 23 to the pulley 26. The eccentric cam 22 is connected to the pulley 26. The reflector 25, which is connected to the eccentric cam 22, includes a tab that serves as an index for determination of its position (rotation angle). The sensor 24 is an index sensor that detects arrival or passage of the reflector 25 as a base point.

The release-oil removing blade 17 includes: a support shaft 17*b* that is rotatably supported around a fixed axis at one end thereof; and the end portion 17*d* that is supported on the other end (free end) of the support shaft 17*b* such that the end portion 17*d* is rotatable about an axis parallel to a central axis of the heating roller 11. The end portion 17*d* is a "blade" in a narrow sense. The first torsion spring 17*a* exerts a rotary force on the one end of the support shaft 17*b*, which is supported on the fixed axis, clockwise in FIG. 2 (in a direction causing the end portion 17*d* to move away from the heating roller 11). The first torsion spring 17*a* has one end engaged in the fixed axis and the other end engaged in the support shaft 17*b*. The second torsion spring 17*c* exerts rotary force on the end portion 17*d* counterclockwise in FIG. 2 (in a direction pressing the end portion 17*d* against the heating roller 11). The second torsion spring 17*c* has one end engaged in the support shaft 17*b* and the other end engaged in the end portion 17*d*. The first torsion spring 17*a* and the second torsion spring 17*c* constitute the drive unit that drives the release-oil removing blade.

An oiling controller 21 (see FIG. 3), which will be described later, controls the stepping motor 23 for stepping drive in a forward rotation direction (which rotates the eccentric cam 22 clockwise in FIG. 2). The oiling controller 21 sets a point where a detection signal of the sensor 24 switches from H (the tab of the reflector 25 as an index is not detected) to L (the tab is detected) as a base point (home position where the rotation angle is zero), initializes (clears) count data to zero when the detection signal switches from H to L, and then changes the count data by one unit for each step motion. The count data represents the rotation angle of the eccentric cam 22 (rotation angle of the support shaft 17*b*). Over a period when the end portion 17*d* of the release-oil removing blade 17 is in contact with the heating roller 11, pressure from the end portion 17*d* on the heating roller 11 corresponds to the count data. Over a period when the end portion 17*d* of the release-oil removing blade 17 is out of contact with the heating roller 11, distance between the end portion 17*d* and the heating roller 11 corresponds to the count data. The oiling controller 21 controls the stepping motor 23 for the stepping drive to drive the release-oil removing blade 17 via the eccentric cam 22, and controls, based on the count data, (change of) the pressure of the end portion 17*d* of the release-oil removing blade 17 against the heating roller 11, and movement of the end portion 17*d* towards or away from the heating roller 11.

While the imaging web is conveyed (hereinafter, "during the web conveyance"), oil 18 on the heating roller 11 is continuously consumed by the imaging web 6. In contrast, because the oil is not consumed by the imaging web 6 before the web conveyance is started, an excessive amount of oil 18 is applied onto the surface of the heating roller 11 using the oiling web 10. In view of the circumstances, before the web conveyance is started, the oiling controller 21 causes the stepping motor 23 to rotate so that the end portion 17*d* of the release-oil removing blade 17 comes into contact with the heating roller 11 at high pressure, thereby removing the oil sticking to the surface of the heating roller 11. This oil removal prevents an excessive amount of oil from being applied onto sticker paper when the web conveyance is started to perform printing on sticker paper or the like. However, if the end portion 17*d* of the release-oil removing blade 17 is kept pressed against the heating roller 11 during the web conveyance, the oil on the surface of the heating roller 11 becomes insufficient, which decreases releasability between the heating roller 11 and toner. As a result, the toner undesirably adheres to the surface of the heating roller 11.

Accordingly, the oiling controller 21 of the present embodiment causes the pressure of the end portion 17*d* of the release-oil removing blade 17 on the heating roller 11 to be lowered gradually with oil supply held stopped over a period when excessive oil application may occur, and then, when the period has elapsed, the oiling controller 21 causes the release-oil removing blade 17 to move away from the heating roller 11 and causes the oil supply to be started.

Figure 3:
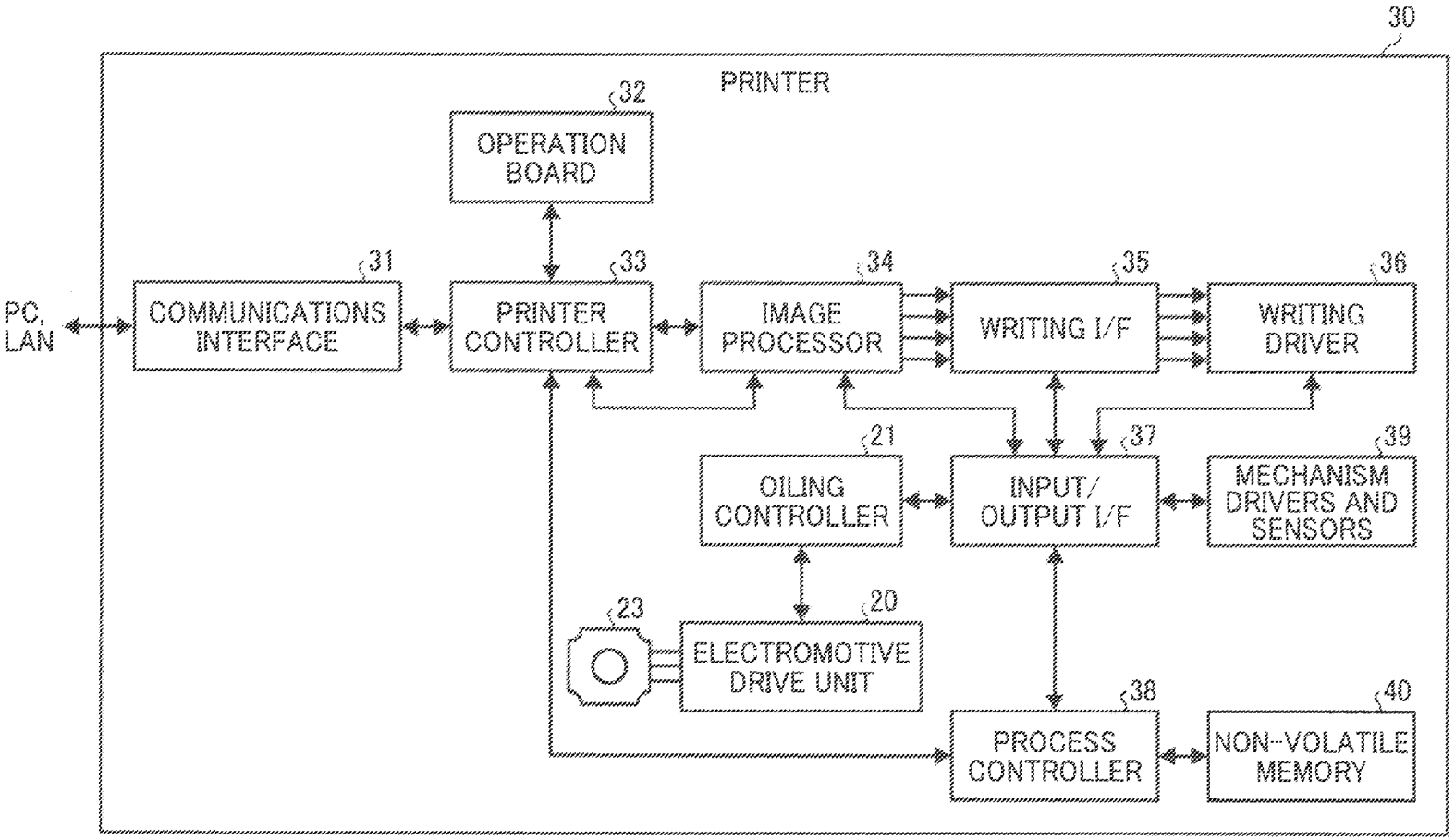
FIG. 3 is a block diagram schematically illustrating an electrical configuration of the printer according to the embodiments.

FIG. 3 illustrates an overview of an image processing system of the printer 30 illustrated in FIG. 1. Print command is transmitted from a personal computer (PC), which is directly connected to the printer 30, via a communications interface (I/F) 31 or from a PC connected to the printer 30 via a local area network (LAN), Ethernet (registered trademark), or the like network, to a printer controller 33. The print command contains information about printing conditions, such as sheet size and whether one-sided printing or two-sided printing, and document-and-image data. The printer controller is referred to as a system controller in some cases.

The document-and-image data in the received print command is rendered into image data and output to an image processor 34. The image processor 34 converts the image data into image data suitable for printing performed by the image forming mechanism illustrated in FIG. 1 according to image-forming process control performed by a process controller 38, rasterizes the to-be-printed image data in image memory in the image processor 34, and outputs the data to a writing I/F 35. The writing I/F 35 turns on and off or modulates a writing laser beam emitted from a laser diode in the laser exposure device 3 according to the to-be-printed image data.

Actuators (electric motors and solenoids) for various sensors and an image forming unit in the mechanism of the printer 30 in FIG. 1 belong to a "mechanism drivers and sensors" block 39 and are connected to an input/output I/F 37. The process controller 38 reads output detection signals of the various sensors via the input/output I/F 37 and the drives the actuators of the image forming unit in the "mechanism drivers and sensors" block 39 via the input/output I/F 37. The process controller 38 also controls signal input/output timing of and operation timing for the image processor 34, the writing I/F 35, and a writing driver 36 via the input/output I/F 37. The electromotive drive unit 20 includes the sensor 24 and a motor driver. The oiling controller 21 reads an output detection signal of the sensor 24 and drives the stepping motor 23 via the motor driver of the electromotive drive unit 20. The oiling controller 21 includes a microcomputer (microprocessing unit (MPU)) that includes a central processing unit (CPU), random access memory (RAM), and read only memory (ROM).

Figure 4:
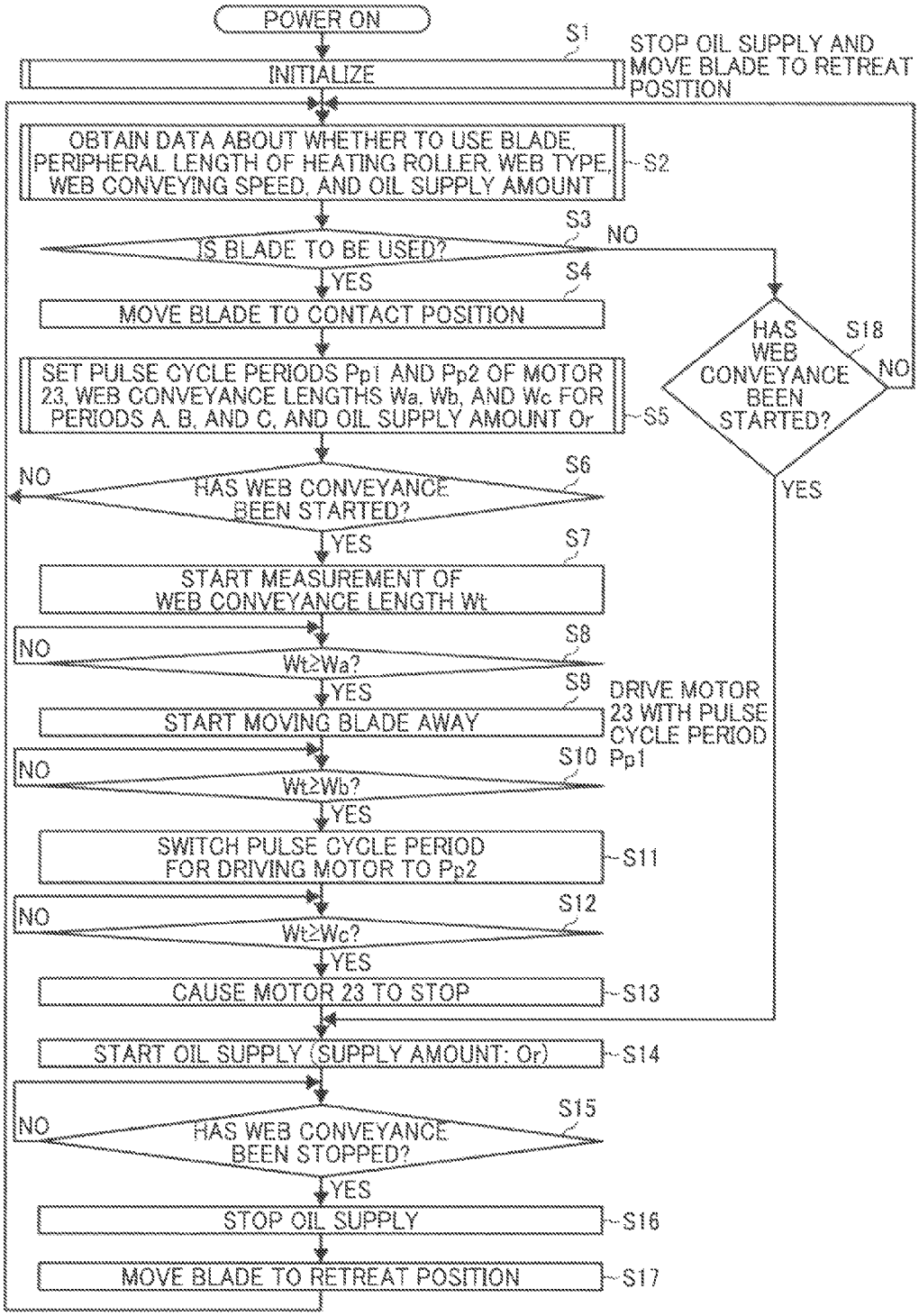
FIG. 4 is a flowchart illustrating an overview of oil control to be carried out by an oiling controller to control movement of a blade of the electromotive drive unit according to the embodiments.

FIG. 4 is a flowchart illustrating an overview of the oiling control to be carried out by the oiling controller 21 (or, more specifically, the CPU in the oiling controller 21). When operating voltage is applied due to power-on or return from an energy-saving mode to an operating mode, the oiling controller 21 starts and initializes the oiling controller 21 itself and the electromotive drive unit 20. If these operations have been performed properly, the oiling controller 21 instructs the "mechanism drivers and sensors" block 39 to stop oil supply from the oil supplying unit 14, and drives the electromotive drive unit 20 to move the end portion 17*d* of the release-oil removing blade 17 to a position where the end portion 17*d* is distant enough from the heating roller 11 and out of contact with release oil on the heating roller 11; or, put another way, a retreat position where the end portion 17*d* is away from the release oil (Step S1). In response to this instruction, the "mechanism drivers and sensors" block 39 causes the oil supplying unit 14 to stop the oil supply.

In this moving process of the end portion 17*d*, the oiling controller 21 controls the stepping motor 23 for the stepping drive in the forward rotation direction to move the end portion 17*d* to the retreat position while monitoring a detection signal of the sensor 24. When the detection signal switches from H to L, the oiling controller 21 initializes count data of an angle counter (angle count register, which is one area of internal memory) to zero, and then counts up the number of driving steps to obtain a count value. When the count value reaches a value corresponding to a position where a portion, which is closest to a rotation center of the eccentric cam 22, on a surface of an outer circumference of the eccentric cam 22 becomes opposed to the support shaft 17*b* (blade retreat position), the oiling controller 21 causes the stepping motor 23 to stop. In this state, the eccentric cam 22 is in a rotational position rotated by 90 degrees clockwise further from a rotational position illustrated in S703 of FIG. 8 while the release-oil removing blade 17 is rotated further clockwise from the rotational position illustrated in S703 of FIG. 8 to place the end portion 17*d* of the release-oil removing blade 17 in a position most away from the heating roller 11.

Referring back to FIG. 4, the oiling controller 21 requests the process controller 38 for oiling setting data of the fixing unit, reads the oiling setting data (data set) from a non-volatile memory 40 via the process controller 38, and loads the oiling setting data into the internal memory of the oiling controller 21 (Step S2). The oiling setting data set includes instruction as to whether to use or not to use the blade, peripheral length of the heating roller (specifications of the roller), web type (cut-out plain paper, continuous paper, or a web to which paper is pressure bonded), web conveying speed (i.e., image forming speed), selection between "automatic calculation of blade control values" and "user setting values," length of web conveyance (hereinafter, "web conveyance length") Wa for an oil-removing period A, a web conveyance length Wb in a first period B (conveyance length in a first moving-away period), a web conveyance length Wc in a second period C (conveyance length in a second moving-away period), a first pulse cycle period Pp1 (reciprocal of a first speed), a second pulse cycle period Pp2 (reciprocal of a second speed), and a release-oil supply amount (more particularly, amount of oil to be supplied per unit time; i.e., oil supply speed).

Among the above-described values, default values have been initially set for the instruction as to whether to use or not to use the blade, the selection between "automatic calculation of blade control values" and "user setting values," the web conveyance length Wa in the oil-removing period A, the web conveyance length Wb in the first period B (conveyance length in the first moving-away period), the web conveyance length Wc in the second period C (conveyance length in the second moving-away period), the first pulse cycle period Pp1 (reciprocal of the first speed), the second pulse cycle period Pp2 (reciprocal of the second speed), and the release-oil supply amount. These values are also user-configurable by using an operation board 32 or PC.

The first moving-away period is a period of time from start of the earliest fixing by the heating roller 11 until amount of the release oil applied to the heating roller 11 reaches predetermined constant amount. The first moving-away period is determined in advance based on experiment or the like. The second moving-away period can be determined arbitrarily.

The peripheral length of the heating roller (specifications of the roller) is one of specifications data of the fixing unit obtained by the process controller 38 from the oiling controller 21 of the fixing unit during the initialization at power-on, and is written to the non-volatile memory 40. The web type is written to the non-volatile memory 40 by the process controller 38 in response to designation of transfer medium (recording paper) in paper feed trays by a user through the operation board 32 or PC. The web conveying speed (i.e., the image forming speed) is written to the non-volatile memory 40 by the process controller 38 according to the designation of transfer medium.

If the instruction as to whether to use or not to use the blade, which is obtained at Step S2, indicates that the blade is not to be used (NO at Step S3), the oiling controller 21 waits for start of web conveyance (arrival of the first piece of paper, on which an image has been formed, at the fixing unit) (Step S18). When the web conveyance is started, the oiling controller 21 causes the oil supplying unit 14 to start oil supply to the oiling web 10 (Step S14). Thereafter, when a sequence of printing operations (forming an image on the paper) specified via the operation board 32 is finished and conveyance of the imaging web is stopped (YES at Step S15), the oiling controller 21 causes the oil supplying unit 14 to stop the oil supply (Step S16) and drives the release-oil removing blade 17 to move to the retreat position (Step S17).

If the instruction as to whether to use or not to use the blade, which is obtained at Step S2, indicates that the blade is to be used (YES at Step S3), the oiling controller 21 drives the release-oil removing blade 17 to move to a pressed-lowermost position (which is a contact position where the release-oil removing blade 17 is in contact with the heating roller 11) (FIG. 2) (Step S4). More specifically, the oiling controller 21 controls the stepping motor 23 for the stepping drive in the forward rotation direction to increment the count data of the angular counter by one for each step motion. When the count data reaches a count value corresponding to a position where a portion, which is farthest from the rotation center of the eccentric cam 22, on the surface of the outer circumference of the eccentric cam 22 becomes opposed to the support shaft 17*b* (the pressed-lowermost position of the blade), the oiling controller 21 causes the stepping motor 23 to stop. In this state, the eccentric cam 22 is in the rotational position illustrated in FIG. 2; the release-oil removing blade 17 is in an "in-contact" position where the end portion 17*d* of the release-oil removing blade 17 is pressed against the heating roller 11 at highest pressure, in other words, the release-oil removing blade 17 is in the pressed-lowermost position.

Next, if the selection between "automatic calculation of blade control values" and "user setting values" obtained at Step S2 indicates that "automatic calculation of blade control values," the oiling controller 21 calculates the first pulse cycle period Pp1 (reciprocal of the first speed) for moving the blade away and the second pulse cycle period Pp2 (reciprocal of the second speed) for moving the blade away, and the web conveyance length Wa in the oil-removing period A, which is the period of time between start of web conveyance and start of moving the blade away, the web conveyance length Wb in the first period B (web conveyance length in the first moving-away period), the web conveyance length Wc in the second period C (web conveyance length in the second moving-away period), all of which are associated with the peripheral length of the heating roller, the web type, and the oil supply amount in the oiling setting data set and are values for driving of the stepping motor 23. The oiling controller 21 sets these values as blade control values. Put another way, the oiling controller 21 writes these values to a reference table (one area in the internal memory of the oiling controller 21). The oiling controller 21 also writes the oil supply amount Or to the reference table (Step S5).

Figure 7:
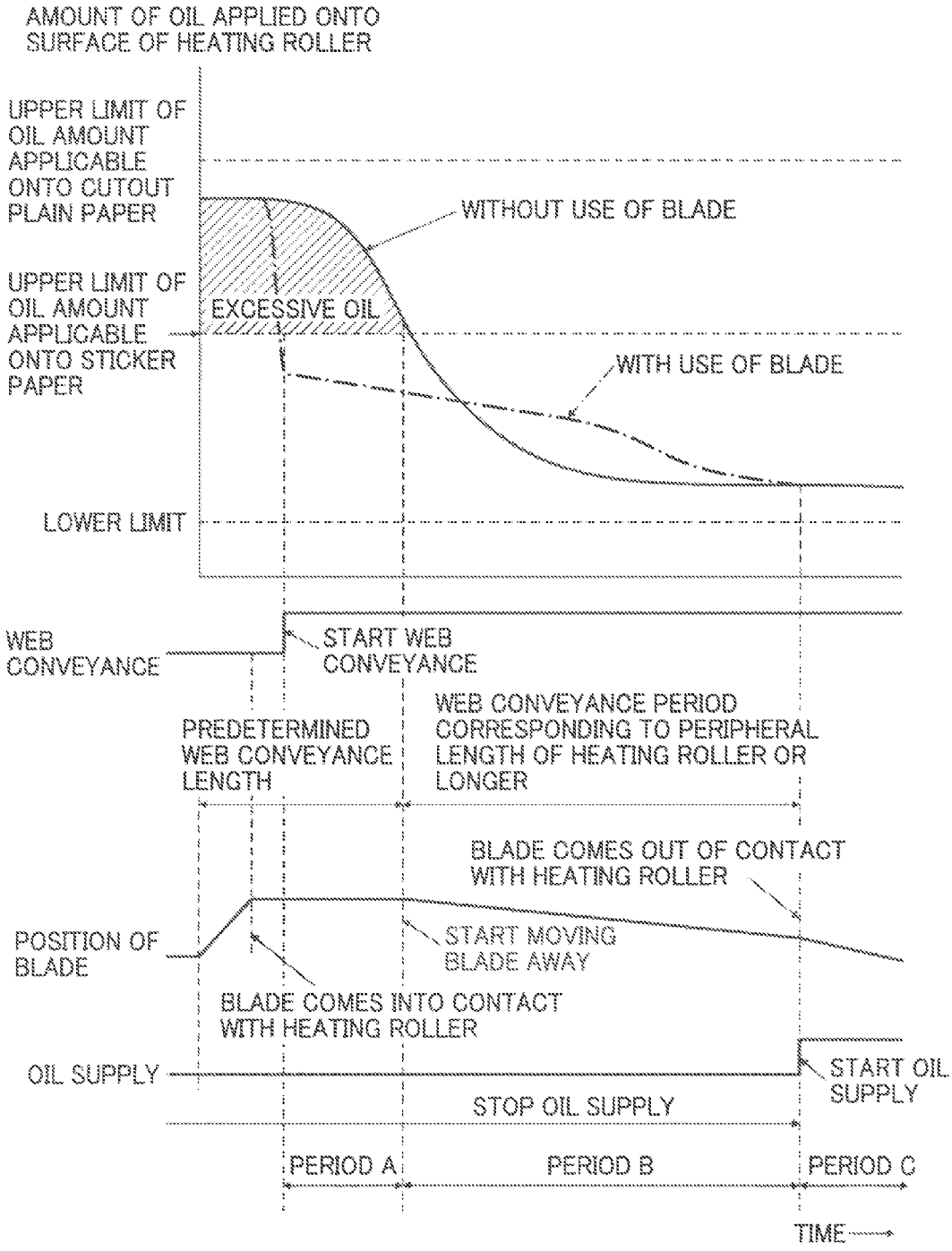
FIG. 7 is a timing chart illustrating variation of amount of oil sticking to a web, onto which fixing is to be performed, over the moving-blade-away time.

The periods A, B, and C are illustrated in FIG. 7. A look-up table for use in determination of the control values is stored in the non-volatile memory 40 in the oiling controller 21. Different data sets, each including the following items: the web conveyance length Wa in the oil-removing period A; the web conveyance length Wb in the first period B (web conveyance length in the first moving-away period); the web conveyance length Wc in the second period C (web conveyance length in the second moving-away period); the first pulse cycle period Pp1 (reciprocal of the first speed); and the second pulse cycle period Pp2 (reciprocal of the second speed), are stored (registered) in the look-up table, associated with different combinations of values of four items (peripheral length of the heating roller 11, web type, web conveying speed, and oil supply amount). The oiling controller 21 reads out one of the data sets (the web conveyance length Wa in the oil-removing period A, the web conveyance length Wb in the first period B, the web conveyance length Wc in the second period C, the first pulse cycle period Pp1, and the second pulse cycle period Pp2) from the look-up table, the one of the data sets being associated with the peripheral length of the heating roller 11, the web type, the web conveying speed, and the oil supply amount obtained at Step S2. Then the oiling controller 21 writes the read-out one of the data sets to the reference table, together with the oil supply amount obtained at Step S2 (Step S5).

Figure 5:
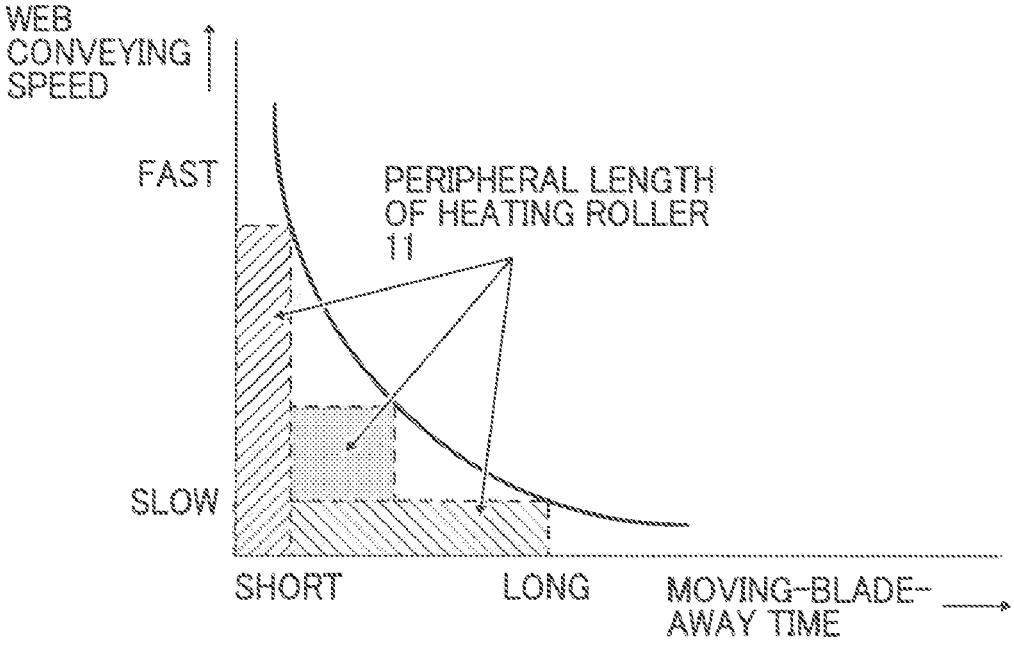
FIG. 5 is a graph illustrating relationships among peripheral lengths of heating rollers, web conveying speed, and moving-blade-away time over which each blade gradually moves away from each heating roller to become out of contact with the heating roller under the control of the oiling controller.

The first pulse cycle period Pp1 (reciprocal of the first speed) is set such that the first pulse cycle period becomes shorter as the web conveying speed (conveying speed of the recording medium) increases. That is, the first speed is set such that the higher the conveying speed of the recording medium, the higher the first speed. The first pulse cycle period Pp1 (reciprocal of the first speed) is set such that the first pulse cycle period is shorter as the oil supply amount increases. This is, the first speed is set such that the greater the oil supply amount of the oil supplying unit 14, the higher the first speed, and the smaller the oil supply amount, the lower the first speed is. As illustrated in FIG. 5, the web conveyance length Wb in the first period B (length of web conveyance in the first moving-away period) is set such that the web conveyance length Wb increases as the peripheral length of the heating roller 11 increases, and that the web conveyance length Wb decreases as the peripheral length of the heating roller 11 decreases. That is, the first moving-away period is set such that the longer the peripheral length of the heating roller 11, the longer the first moving-away period, and that the shorter the peripheral length of the heating roller 11, the shorter the first moving-away period.

Figure 6:
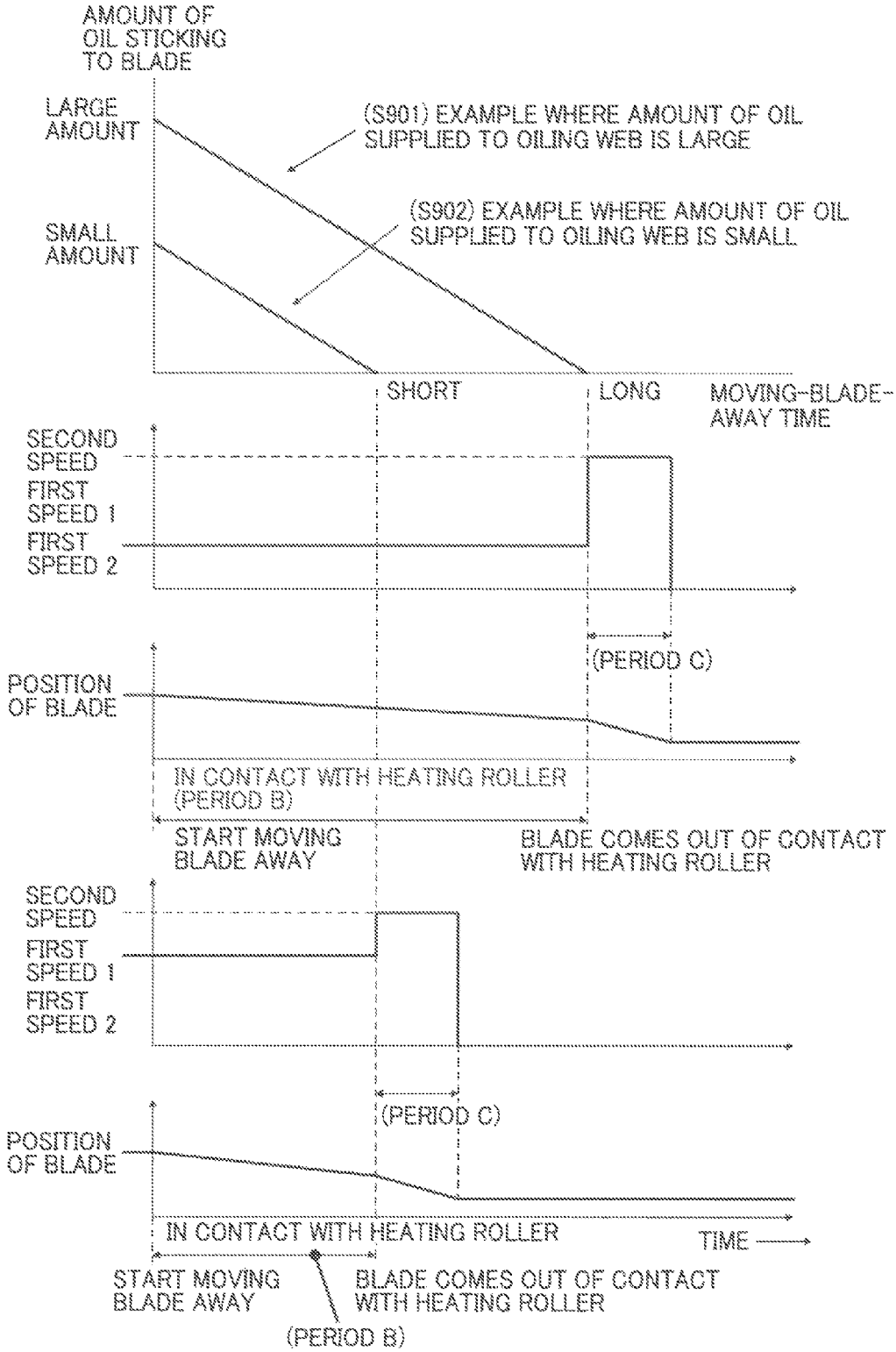
FIG. 6 is a timing chart illustrating speed of the blade and moving-blade-away time, both of which are determined depending on oil supply amount.

Similarly, the web conveyance length Wa in the oil-removing period A is set such that the peripheral length of the heating roller 11 increases as the web conveyance length Wa increases, and that the peripheral length of the heating roller 11 decreases as the web conveyance length Wa decreases. As illustrated in FIG. 6, the web conveyance length Wb in the first period B (length of web conveyance in the first moving-away period) is set such that the web conveyance length Wb increases as the oil supply amount increases, and that the web conveyance length Wb decreases as the oil supply amount decreases. That is, the first moving-away time is set such that the greater the oil supply amount of the oil supplying unit 14, the longer the first moving-away time, and that smaller the oil supply amount of the oil supplying unit 14, the shorter the first moving-away time.

In the present embodiment, each of the second pulse cycle period Pp2 (reciprocal of the second speed) and the web conveyance length Wc in the second period C (length of web conveyance in the second moving-away period) is a fixed value (constant value).

If the selection between "automatic calculation of control values" and "user setting values" obtained at Step S2 indicates that "user setting values," the oiling controller 21 writes the web conveyance length Wa in the oil-removing period A, the web conveyance length Wb in the first period B (length of web conveyance in the first moving-away period), the web conveyance length Wc in the second period C (length of web conveyance in the second moving-away period), the first pulse cycle period Pp1 (reciprocal of the first speed), the second pulse cycle period Pp2 (reciprocal of the second speed), and the oil supply amount obtained at Step S2, to the reference table.

Subsequently, the oiling controller 21 waits for start of web conveyance (Step S6). When the web conveyance is started (YES at Step S6), the oiling controller 21 starts measurement of a web conveyance length Wt (Step S7). Specifically, the oiling controller 21 starts counting pulses of a conveyance synchronizing signal generated by a rotary encoder (not shown) of the web conveying units 7 such that one pulse is generated per unit length of the imaging web 6. More specifically, a countdown from a preset count value, which is set to the web conveyance length Wa in the oil-removing period A in the reference table, is performed each time one pulse of the conveyance synchronizing signal is generated.

When the count value (residual count value) reaches zero; i.e., when the countdown is finished, the oiling controller 21 controls the stepping motor 23 for stepping drive in a forward rotation direction at the first pulse cycle period Pp1 given in the reference table to start measurement of web conveyance length Wt (Steps S8 and S9). More specifically, a countdown from a preset count value, which is set to the web conveyance length Wb (length of web conveyance in the first moving-away period), is performed each time one pulse of the conveyance synchronizing signal is generated.

When the count value (residual count value) reaches zero; i.e., when the countdown is finished (Step S10), the oiling controller 21 switches the pulse cycle period for the stepping drive by the stepping motor 23 in a forward rotation direction, to the pulse cycle period Pp2, and starts measurement of web conveyance length Wt (Step S11). More specifically, a countdown from a preset count value, which is set to the web conveyance length Wc (length of web conveyance in the second moving-away period), is performed each time one pulse of the conveyance synchronizing signal is generated.

When the count value (residual count value) reaches zero; i.e., when the countdown is finished (Step S12), the oiling controller 21 causes the stepping motor 23 to stop (Step S13), and causes the oil supplying unit 14 to start supplying oil of the supply amount Or given in the reference table (Step S14).

The oil supply is continued until conveyance of the imaging web 6 is stopped (Step S15). When the conveyance of the imaging web 6 is stopped, the oiling controller 21 causes the oil supplying unit 14 to stop the oil supply (Step S16). Thereafter, the flowchart returns to Step S2.

According to the above-described oiling control, if "automatic calculation of blade control values" is specified in the selection between "automatic calculation of blade control values" and "user setting values," the first speed is set to be proportional to the web conveying speed such that the higher the web conveying speed, the lower the first speed, and vice versa because the moving-blade-away time varies in inverse proportion to the web conveying speed as shown in FIG. 5. With this setting, amount of oil on the surface of the heating roller 11 can be stabilized even when the web conveying speed is changed. During the moving-blade-away time, the end portion 17*d* of the release-oil removing blade 17 moves away from the heating roller 11 at the first speed (the first pulse cycle period Pp1). The moving-blade-away time is predefined and corresponds to the peripheral length of the heating roller 11 or longer.

Referring to FIG. 6, examples where the amount of oil supplied to the oiling web 10 is relatively large and the amount of oil supplied to the oiling web 10 is relatively small will be described. If the amount of oil supplied to the oiling web 10 is relatively large (S901), the amount of the oil 18 to be applied to the heating roller 11 is relatively large. In this case, when the end portion 17*d* of the release-oil removing blade 17 is brought into contact with the heating roller 11, the amount of oil adhering to the end portion 17*d* of the release-oil removing blade 17 is also relatively large. Hence, it is desirable that, in the course of moving the end portion 17*d* of the release-oil removing blade 17 away from the heating roller 11, the oil 18 adhering to the end portion 17*d* of the release-oil removing blade 17 has to be gradually reduced while spreading the oil thinly on the heating roller 11, thereby applying an appropriate amount of oil on the heating roller 11. To attain this, when "automatic calculation of blade control values" is specified in the selection between "automatic calculation of blade control values" and "user setting values" if the amount of oil supply is relatively large, a first speed 2 (low speed) is set for moving the end portion 17*d* of the release-oil removing blade 17 away from the heating roller 11, thereby prolonging a period of time until the end portion 17*d* of the release-oil removing blade 17 completely separates from the heating roller 11. In contrast, if the amount of oil supplied to the oiling web 10 is relatively small (S902), the amount of the oil 18 to be applied to the heating roller 11 is relatively small. In this case, when the end portion 17*d* of the release-oil removing blade 17 is brought into contact with the heating roller 11, the amount of oil adhering to the end portion 17*d* of the release-oil removing blade 17 is also relatively small. Accordingly, if the amount of oil supply is relatively small, a first speed 1 (high speed) is set for moving the end portion 17*d* of the release-oil removing blade 17 away from the heating roller 11, thereby shortening a period of time until the end portion 17*d* of the release-oil removing blade 17 completely separates from the heating roller 11.

While the end portion 17*d* of the release-oil removing blade 17 is in contact with the heating roller 11, the amount of oil 18 to be applied onto the surface of the imaging web 6 decreases. Hence, in this state, reduced amount of oil retained between the oiling web 10 and the heating roller 11 is relatively small. Accordingly, oil supply to the oiling web 10 that is applying the oil 18 to the heating roller 11 is stopped.

FIG. 7 illustrates a relationship between the amount of oil on the surface of the heating roller 11 and presence or absence of the release-oil removing blade 17 after the web conveyance is started. If the sticker paper 6*p* is used as the recording medium in a situation where the release-oil removing blade 17 is not used, the amount of oil on the surface of the heating roller 11 exceeds an upper limit of an applicable oil amount, with which the sticker paper 6*p* can be pressure bonded to the web, from the start of web conveyance until the web conveyance length reaches a predetermined conveyance length. Put another way, excessive amount of oil is applied onto the web.

In contrast, in a situation where the release-oil removing blade 17 is used, the end portion 17*d* of the release-oil removing blade 17 limits the amount of oil on the surface of the heating roller 11 from the start of web conveyance. Accordingly, the amount of oil on the heating roller 11 can be limited to be equal to or lower than the upper limit of the applicable oil amount, with which the sticker paper 6*p* can be pressure bonded to the web. After the start of web conveyance, when the length of web conveyance reaches a certain conveyance length, the amount of oil on the heating roller 11 is stabilized irrespective of presence or absence of the release-oil removing blade 17.

Figure 8:
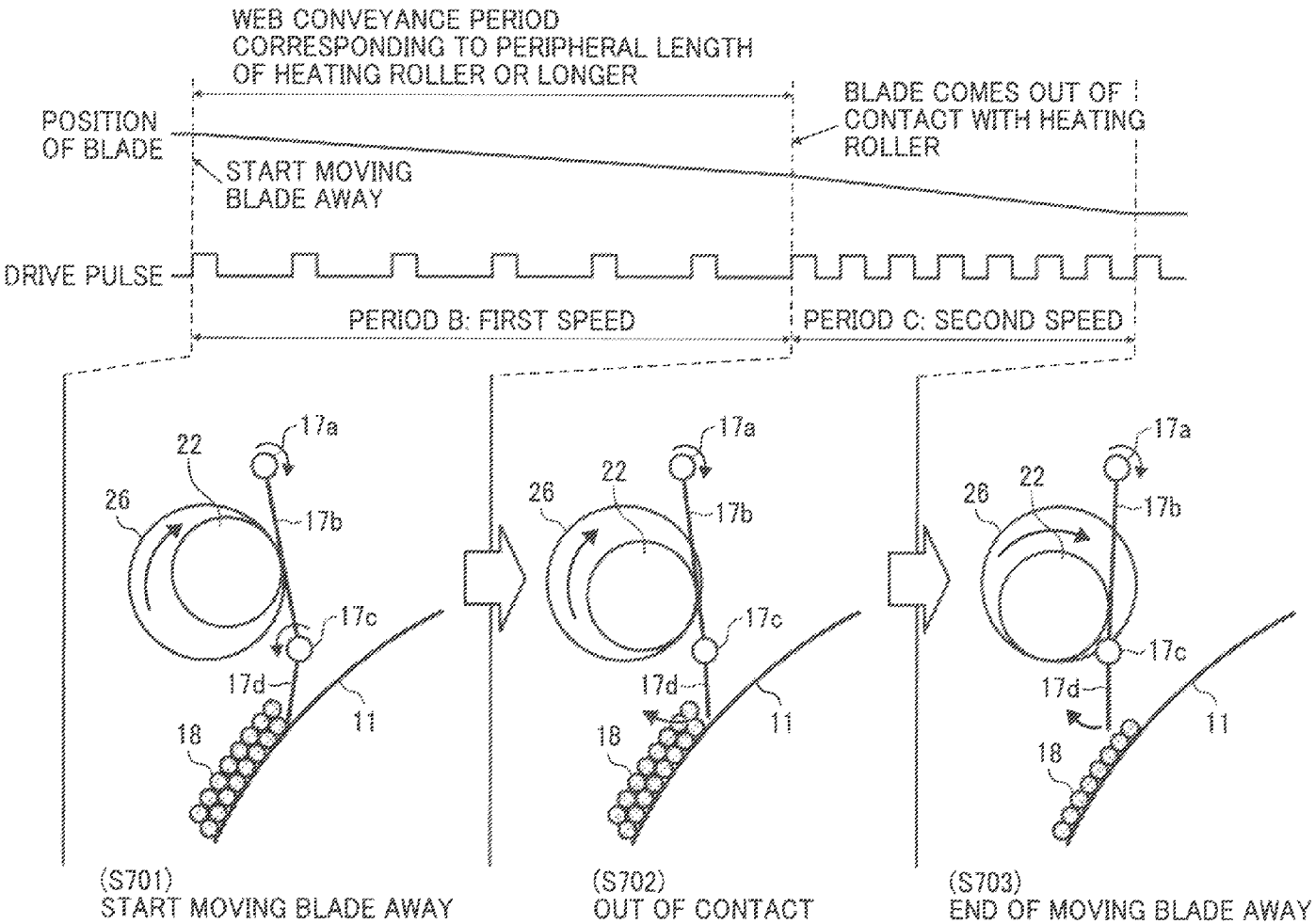
FIG. 8 is an enlarged side view illustrating variation of posture and position of the blade over the moving-blade-away time.
Figure 9A:
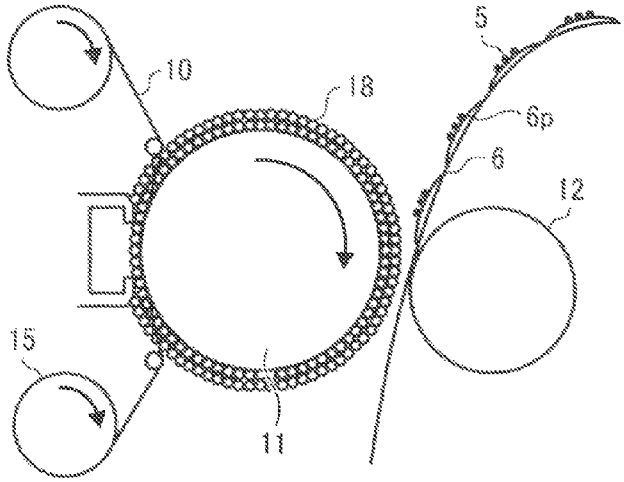
FIG. 9A is an enlarged side view illustrating a state of oil before start of web conveyance when a relatively large amount of oil is supplied in a conventional fixing device.
Figure 9B:
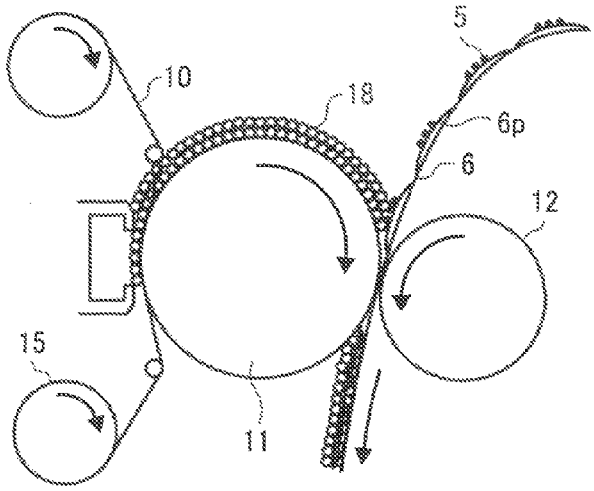
FIG. 9B is an enlarged side view illustrating a state of oil during the web conveyance when a relatively large amount of oil is supplied in the conventional fixing device.
Figure 10A:
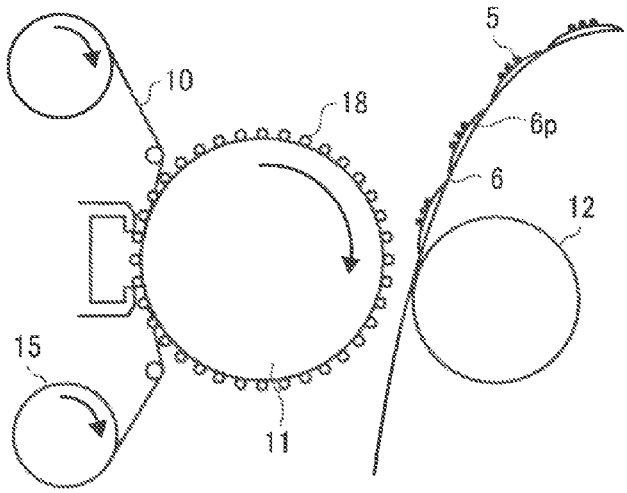
FIG. 10A is an enlarged side view illustrating a state of oil before start of the web conveyance when a relatively small amount of oil is supplied in the conventional fixing device.
Figure 10B:
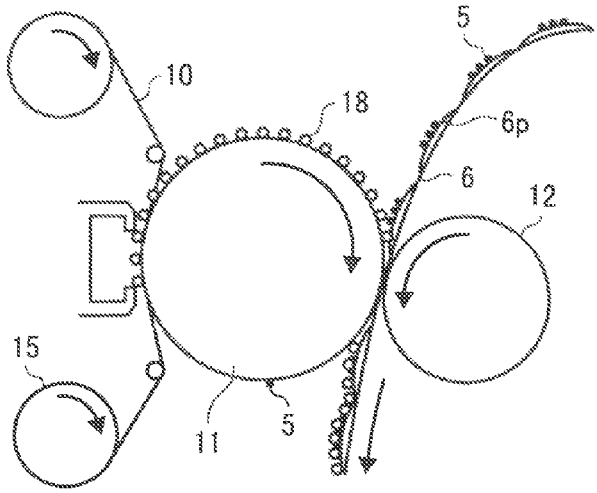
FIG. 10B is an enlarged side view illustrating a state of oil during the web conveyance when a relatively small amount of oil is supplied in the conventional fixing device.

Next, with reference to FIG. 8, speed of the end portion 17*d* of the release-oil removing blade in the period B and the period C illustrated in FIG. 7, will be described below. When the web conveyance length exceeds the predetermined conveyance length Wa (for the period A), moving the end portion 17*d* of the release-oil removing blade 17 away from the heating roller 11 at the first speed (the pulse cycle period Pp1) is started. At start of the moving (S701), if "automatic calculation of blade control values" has been specified in the selection between "automatic calculation of blade control values" and "user setting values," pressure from the end portion 17*d* of the release-oil removing blade 17 on the heating roller 11 is gradually decreased at the first speed over a predetermined period of web conveyance time corresponding to the peripheral length of the heating roller 11 or longer. With this motion, the end portion 17*d* of the release-oil removing blade 17 is in contact with the heating roller 11 during at least a period over which the heating roller 11 makes one complete rotation, which allows an appropriate amount of oil on the surface of the heating roller 11. This prevents the oil sticking to the end portion 17*d* of the release-oil removing blade 17 from sticking onto the outer circumference of the heating roller 11 abruptly. Furthermore, this motion allows the excessive oil sticking to the end portion 17*d* of the release-oil removing blade 17 to be gradually transferred onto the heating roller 11, thereby reducing the oil on the end portion 17*d*. Thereafter, during the period C, or, more specifically, in a period over which the end portion 17*d* of the release-oil removing blade 17 is out of contact with the heating roller 11 (S702), the end portion 17*d* of the release-oil removing blade 17 moves at the second speed (which is higher than the first speed) away from the heating roller 11 to the retreat position.

The oiling setting data set, which is entered through the operation board 32 or PC, is registered in the non-volatile memory 40 of the printer 30. The oiling setting data set include the instruction as to whether to use or not to use the blade, the selection between "automatic calculation of blade control values" and "user setting values," the web conveyance length Wa in the oil-removing period A, the web conveyance length Wb in the first period B (conveyance length in the first moving-away period), the web conveyance length Wc in the second period C (conveyance length in the second moving-away period), the first pulse cycle period Pp1 (reciprocal of the first speed), the second pulse cycle period Pp2 (reciprocal of the second speed), and the release-oil supply amount. Furthermore, the oiling controller 21 has the look-up table for use in determination of the control values. Different data sets, each including the following items: the web conveyance length Wa in the oil-removing period A; the web conveyance length Wb in the first period B (web conveyance length in the first moving-away period); the web conveyance length Wc in the second period C (web conveyance length in the second moving-away period); the first pulse cycle period Pp1 (reciprocal of the first speed); and the second pulse cycle period Pp2 (reciprocal of the second speed), are stored (registered) in the look-up table, associated with different combinations of values of four items (peripheral length of the heating roller 11, web type, web conveying speed, and oil supply amount). If "automatic calculation of blade control values" is specified in the selection between "automatic calculation of blade control values" and "user setting values," the oiling controller 21 reads out one of the data sets (the web conveyance length Wa in the oil-removing period A, the web conveyance length Wb in the first period B, the web conveyance length Wc in the second period C, the first pulse cycle period Pp1, and the second pulse cycle period Pp2) from the look-up table to use the one of the data sets for oiling control, the one of the data sets being associated with the peripheral length of the heating roller 11, the web type, the web conveying speed, and the oil supply amount.

Instead of sticker paper, when conveying a web (such as elongated recording paper or cut-out plain paper) that does not require reduction in oil supply amount at start of web conveyance, it can be set such that the release-oil removing blade 17 is not used in order to prevent the heating roller 11 from being damaged due to insufficient release oil. When conveying sticker paper, it can be set such that the release-oil removing blade 17 is used in order to prevent application of an excessive amount of release oil.

If "user setting values" is specified in the selection between "automatic calculation of control values" and "user setting values," the oiling controller 21 uses the following values, which are set via operation board 32 or PC, for oiling control: the web conveyance length Wa in the oil-removing period A; the web conveyance length Wb in the first period B (length of web conveyance in the first moving-away period); the web conveyance length Wc in the second period C (length of web conveyance in the second moving-away period); the first pulse cycle period Pp1 (reciprocal of the first speed); and the second pulse cycle period Pp2 (reciprocal of the second speed). Accordingly, a user is allowed to adjust or change these values by using the operation board 32 or PC. That is, this allows oiling control to be performed in a manner desired by the user.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing member that fixes a toner image onto a recording medium, the fixing member being rotatably arranged so as to be opposed to a surface, on which the toner image has been formed, of the recording medium;

a pressing member that presses the recording medium against the fixing member from a back surface side of the recording medium;

an oiling unit that applies release oil onto a surface of the fixing member to clean the surface of the fixing member;

an oil supplying unit that supplies the release oil to the oiling unit;

a removing member that is arranged between a downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member;

a drive unit that drives the removing member; and an oiling control unit that, when starting fixing onto the recording medium, controls the drive unit such that the removing member gradually moves from the in-contact state to the out-of-contact state, wherein:

the drive unit drives the removing member by controlling pressure from the removing member on the fixing member, and the oiling control unit controls the drive unit such that the removing member moves at a first speed until a first moving-away period, which is a period of time from a start of the fixing until an amount of the release oil applied to the fixing member reaches a predetermined amount, has elapsed so as to gradually decrease the pressure on the fixing member, thereby moving the removing member from the in-contact state into the out-of-contact state, and the removing member moves at a second speed, which is higher than the first speed, until a second moving-away period has elapsed after the first moving-away period has elapsed so as to move the removing member away from the fixing member.

2. The fixing device according to claim 1, wherein the oiling control unit controls the drive unit such that the removing member moves into the in-contact state before the start of the fixing.

3. The fixing device according to claim 1, wherein the first speed increases as a conveying speed of the recording medium increases.

4. The fixing device according to claim 1, wherein the first speed decreases as the amount of oil supplied by the oil supplying unit increases.

5. The fixing device according to claim 1, wherein the first speed is determined by a user in advance.

6. The fixing device according to claim 1, wherein the first moving-away period increases as a peripheral length of the fixing member increases.

7. The fixing device according to claim 1, wherein the oil supplying unit stops supply of the release oil from the start of the fixing until the second moving-away period has elapsed.

8. The fixing device according to claim 1, wherein the removing member includes an end portion, the end portion is brought into contact with the fixing member by increasing the pressure from the end portion on the fixing member, and is brought out of contact with the fixing member by decreasing the pressure from the end portion on the fixing member.

9. The fixing device according to claim 8, wherein the removing member includes a support shaft that rotates about a fixed axis, the end portion is supported by the support shaft, and the drive unit includes:

an electromotive drive unit that includes a driving member that drives the support shaft to rotate about the fixed axis in an approaching direction, in which the end portion moves towards the fixing member, and to move in a direction opposite to the approaching direction; and a first spring that drives the support shaft to rotate about the fixed axis in a retreat direction, in which the end portion moves away from the fixing member.

10. The fixing device according to claim 9, wherein the end portion is supported by the support shaft so as to be rotatable about a parallel axis that is parallel to a central axis of the fixing member, and the drive unit further includes a second spring that drives the end portion to rotate about the parallel axis relative to the support shaft such that the end portion presses against the fixing member.

11. The fixing device according to claim 9, wherein the electromotive drive unit includes:

an eccentric cam that is the driving member which is in contact with the support shaft so as to press the end portion against the fixing member in the approaching direction; and an electric motor that drives the eccentric cam to rotate.

12. The fixing device according to claim 11, wherein the electric motor is a stepping motor capable of changing rotation speed in a stepwise fashion, the electromotive drive unit includes:

an index for use in determination of a rotation angle of the eccentric cam, the index being connected to the eccentric cam; and an index sensor that detects the index at a fixed position, and wherein the oiling control unit counts driving steps of the eccentric cam driven by the stepping motor to obtain a count value, using switching between detection and non-detection of the index by the index sensor, as a base point, and recognizes a position of the end portion with respect to the fixing member based on the count value.

13. An image forming apparatus comprising:

a photosensitive member;

an electrostatic charging unit that uniformly electrostatically charges the photosensitive member;

an exposure device that exposes a surface of the photosensitive member which has been electrostatically charged, with image light to form a latent image;

a developing device that develops the latent image into a toner image;

a transfer unit that transfers the toner image onto a recording medium by using an image carrier; and a fixing device that fixes the toner image onto the recording medium, wherein the fixing device includes:

a fixing member that fixes the toner image onto the recording medium, the fixing member being rotatably arranged so as to be opposed to a surface, on which the toner image has been formed, of the recording medium;

a pressing member that presses the recording medium against the fixing member from a back surface side of the recording medium;

an oiling unit that applies release oil onto a surface of the fixing member to clean the surface of the fixing member;

an oil supplying unit that supplies the release oil to the oiling unit;

a removing member that is arranged between a downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member;

a drive unit that drives the removing member;

an oiling control unit that, when starting fixing onto the recording medium, controls the drive unit such that the removing member gradually moves from the in-contact state to the out-of-contact state; and a storage unit that stores speed information of the recording medium, wherein the oiling control unit sets a first speed corresponding to the speed information stored in the storage unit.

14. The image forming apparatus according to claim 13, further comprising a storage unit that stores instruction information as to whether to use or not to use the removing member, wherein the oiling control unit holds the removing member at a retreat position away from the release oil if the instruction information in the storage unit indicates that the removing member is not to be used.

15. The image forming apparatus according to claim 13, further comprising:

a storage unit that stores conveying speed of the recording medium and amount of oil to be supplied by the oil supplying unit, wherein:

the drive unit drives the removing member by controlling pressure from the removing member on the fixing member, and the oiling control unit calculates a first speed and a first moving-away period which is a period of time from start of fixing until amount of the release oil applied to the fixing member reaches predetermined amount, depending on the conveying speed and the amount of oil to be supplied, both of which are stored in the storage unit, and controls the drive unit such that the removing member moves at the first speed until the first moving-away period has elapsed from the start of the fixing so as to gradually decrease the pressure on the fixing member, thereby moving the removing member from the in-contact state into the out-of-contact state, and the removing member moves at a second speed, which is higher than the first speed, until a second moving-away period has elapsed from the first moving-away period has elapsed so as to move the removing member away from the fixing member.

16. The image forming apparatus according to claim 15, wherein the storage unit stores a plurality of data sets of first speed and first moving-away period, depending on peripheral lengths of fixing members, and the oiling control unit drives the removing member according to the first speed and the first moving-away period which are associated with the peripheral length of the fixing member.

17. The image forming apparatus according to claim 13, wherein the recording medium is printing paper glued and pressure bonded to any one of an elongated web and a sheet.

18. A fixing method for use in a fixing device, the fixing device including:

a fixing member that fixes a toner image onto a recording medium, the fixing member being rotatably arranged so as to be opposed to a surface, on which the toner image has been formed, of the recording medium;

a pressing member that presses the recording medium against the fixing member from a back surface side of the recording medium;

an oiling unit that applies release oil onto a surface of the fixing member to clean the surface of the fixing member;

an oil supplying unit that supplies the release oil to the oiling unit;

a removing member that is arranged between a downstream side of the oiling unit and an upstream side of the pressing member in a rotating direction of the fixing member and that is movable between an in-contact state where the removing member is in contact with the surface of the fixing member and an out-of-contact state where the removing member is out of contact with the surface of the fixing member, and an oiling control unit that, when starting fixing onto the recording medium, controls a drive unit such that the removing member gradually moves from the in-contact state to the out-of-contact state, the fixing method, when starting fixing onto the recording medium, comprising:

moving the removing member gradually from the in-contact state to the out-of-contact state;

driving, by the drive unit, the removing member by controlling pressure from the removing member on the fixing member; and controlling the oiling control unit such that the removing member moves at a first speed until a first moving-away period, which is a period of time from start of the fixing until an amount of the release oil applied to the fixing member reaches a predetermined amount, has elapsed so as to gradually decrease the pressure on the fixing member, thereby moving the removing member from the in-contact state into the out-of-contact state, and moving the removing member at a second speed, which is higher than the first speed, until a second moving-away period has elapsed after the first moving-away period has elapsed so as to move the removing member away from the fixing member.

* * * * *